US009637846B1

(12) United States Patent
Kuo et al.

(10) Patent No.: US 9,637,846 B1
(45) Date of Patent: May 2, 2017

(54) DOUBLE-SIDED FABRIC STACKED WITH CONTINUOUS LINEAR MATERIAL IN PREDETERMINED KNITTING SECTION

(71) Applicant: Aknit International Ltd., Apia (WS)

(72) Inventors: Ming-Sheng Kuo, Apia (WS); Yu-Lin Li, Apia (WS); Chien-Hui Yang, Apia (WS)

(73) Assignee: AKNIT INTERNATIONAL LTD., Apia (WS)

( * ) Notice: Subject to any disclaimer, the term of this patent is extended or adjusted under 35 U.S.C. 154(b) by 0 days.

(21) Appl. No.: 15/177,806

(22) Filed: Jun. 9, 2016

(51) Int. Cl.
*D04B 1/18* (2006.01)
*D04B 1/12* (2006.01)
*D04B 1/02* (2006.01)
*D04B 1/10* (2006.01)

(52) U.S. Cl.
CPC ..... *D04B 1/123* (2013.01); *D04B 1/02* (2013.01); *D04B 1/102* (2013.01); *D04B 1/18* (2013.01)

(58) Field of Classification Search
CPC ..... D04B 1/123; D04B 1/02; D04B 1/102; D04B 1/18
See application file for complete search history.

(56) References Cited

U.S. PATENT DOCUMENTS 616,524 A * 12/1898 Cartledge ..... D04B 1/24 66/171
782,480 A * 2/1905 Benndorf ..... D04B 15/80 66/123
1,831,964 A * 11/1931 Lombardi ..... D04B 1/14 66/190
1,976,885 A * 10/1934 Levin ..... D04B 1/00 66/190
2,040,965 A * 5/1936 Verbeek ..... D04B 1/00 66/83
2,069,819 A * 2/1937 Diem ..... D04B 1/00 66/190
2,105,301 A * 1/1938 Saftlas ..... D04B 1/14 66/190
2,108,925 A * 2/1938 Raynor ..... D04B 1/14 66/190
2,176,533 A * 10/1939 Logan ..... D04B 1/10 66/190
2,185,844 A * 1/1940 Gastrich ..... D04B 11/00 66/126 R
(Continued)

*Primary Examiner* — Danny Worrell
(74) *Attorney, Agent, or Firm* — Muncy, Geissler, Olds & Lowe, P.C.

(57) ABSTRACT

A double-sided fabric stacked with a continuous cord material in a predetermined knitting section. The double-sided fabric is knit from a face yarn by a flat knitting machine including a front needle bed, a back needle bed and a loop presser bed. The front needle bed includes a plurality of front knitting needles. The back needle bed includes a plurality of back knitting needles. The loop presser bed is disposed above the front needle bed or the back needle bed, and includes right-directed knitting pressing pieces and left-directed knitting pressing pieces. The double-sided fabric is further embedded with a continuous cord material, which is pressed into the predetermined knitting section by the right-directed knitting pressing pieces and the left-directed knitting pressing pieces to become folded and stacked in the predetermined knitting section.

15 Claims, 16 Drawing Sheets

(56) References Cited

U.S. PATENT DOCUMENTS

| | | | | | |
|---|---|---|---|---|---|
| 2,236,758 | A * | 4/1941 | Lumsden | D04B 1/18 | 66/190 |
| 3,115,693 | A * | 12/1963 | Chandler | D04B 1/16 | 156/148 |
| 3,774,412 | A * | 11/1973 | Schichman | D04B 9/18 | 28/271 |
| 3,964,277 | A * | 6/1976 | Miles | D04B 9/16 | 66/190 |
| 4,794,767 | A * | 1/1989 | Lombardi | D04B 1/123 | 28/155 |
| 5,299,435 | A * | 4/1994 | Whalley | D04B 1/123 | 66/190 |
| 6,151,922 | A | 11/2000 | Shimasaki | | |
| 2016/0265146 | A1* | 9/2016 | Liao | D04B 13/00 | |

* cited by examiner

Fig. 2 X-X

DOUBLE-SIDED FABRIC STACKED WITH CONTINUOUS LINEAR MATERIAL IN PREDETERMINED KNITTING SECTION

FIELD OF THE INVENTION

The present invention relates to a double-sided fabric, and particularly to a double-sided fabric stacked with a continuous cord material in a predetermined knitting section.

BACKGROUND OF THE INVENTION

In the modern society that values health, environmental protection and fashion, consumers demand higher comfort and design requirements on garment fabrics. In response to market needs of human wear, fabric manufacturers focus on making fabrics of different colors and pattern changes. If a continuous cord material can be embedded into a double-sided base yarn during a knitting process and be knit at the same time, not only a thicker and denser double-sided fabric having more pattern changes can be formed, but also the double-sided fabric manufactured may achieve more outstanding performances in fluffiness and shape sustainability. Such fabric is particularly suitable for making daily life consumer products including human outerwear, shoes or handbags. In currently existing technologies associated with a flat bed knitting machine that embeds a continuous cord material to be embedded, the embedding process of the continuous cord material to be embedded is performed by yarn stitching operations using knitting needles. Thus, when the length of the continuous cord material to be embedded exceeds 1 inch, due a certain inclined angle produced when the continuous cord material is fed by a yarn feeder, the continuous cord material may not be reliably stitched by the knitting needle in the yarn stitching process, hence easily resulting in an unsatisfactory fabric. That is to say, when adopting the above technology for embedding the continuous cord material, the length of the continuous cord material cannot exceed 1 inch. Thus, the development of fabrics manufactured from the above knitting technology also suffers from severe restrictions. It should be noted that, the flat bed knitting machine described refers to a model that includes a front needle bed and a back needle bed. During a knitting process, such flat bed knitting machine is capable of manufacturing not only a single-sided fabric by independently using one of the needle beds but also a double-sided fabric by simultaneously using the front and back needle beds that weave alternately.

To improve the above issue, the U.S. Pat. No. 6,151,922A discloses "Method of Knitting Inlaid Fabric and Inlaid Fabric Knitted by the Method". In the above disclosure of the method of knitting an inlaid fabric including an inlay yarn (equivalent to the foregoing embedded continuous cord material), the flat bed knitting machine used includes at least a pair of horizontally extending needle beds arranged in front and back to be opposed to each other across a needle gap and each including a number of needles. Each of the pair of needle beds includes a plurality of knitting needles capable of transferring stitches of loops between the needle beds, and either or both of the needle beds can be racked laterally. The knitting process of knitting the inlaid fabric including a base knitting fabric portion (equivalent to the foregoing base yarn) and the inlay yarn (equivalent to the foregoing continuous cord material) includes steps of: a step that the base knitting fabric portion is knitted; a step that inlay yarn holding loops are formed by retaining loops of the base knitting fabric portion retained by the needles on the first needle bed to said needles on the opposed second needle bed through a split knit process, whereby the loops are retained to the needles on both of the first and second needle beds; a step that the inlay yarn is made to run across the loops retained to the needles on the first and second needle beds; a step that the inlay yarn holding loops retained by the needles on the second needle bed are transferred to the needles on the first needle bed to be overlapped with the loops of the base knitting fabric portion; and a step that a yarn is fed to the needles of the first needle bed to form loops of the next course. The above disclosure further discloses an inlaid fabric knitted by the above method. The inlaid fabric is characterized that, an elastic yarn is used as a base knitting fabric portion and a non-elastic yarn is used as inlay yarn, and the elastic yarn is knitted in its stretched state during the knitting so that the inlay yarn can be formed into a pile-like form. It is seen from the above disclosure that, one main purpose of using a non-elastic yarn as the inlay yarn is to maintain a final shape of the inlay fabric. Thus, only when knitting process of the above disclosure is complete, the base knitting fabric portion using an elastic yarn can then be shrunk back to the pile-like form. Thus, it is known that, in the knitting method of the above disclosure, the needles of one of the needle beds of the flat needle bed machine are applied for knitting the base yarn, whereas the other needle bed is used to transfer stitches of loops that maintain the positions of the inlay yarn after having been transferred. That is to say, instead of being capable of manufacturing a double-sided fabric, the above knitting method is only capable of manufacturing a single-sided fabric. Further, the inlaid yarn of the disclosure cannot be stacked in a predetermined knitting section, and may fail to meet consumer market needs. Therefore, there is a need for a solution for solving the above issues and limitations of the known technologies.

SUMMARY OF THE INVENTION

It is a primary object of the present invention to solve the above issues of the known technologies. In addition to embedding a continuous cord material in a normal loop stitching process for a double-sided fabric, the present invention further causes the continuous cord material to be stacked in a predetermined knitting section, so as to manufacture a double-sided fabric that appears relief embossed and has different thicknesses to effectively satisfy consumer market needs.

According to the above object, the present invention provides a double-sided fabric stacked with a continuous material in a predetermined knitting section. The double-side fabric is knit a face yarn by a flat bed knitting machine, which includes a front needle bed, a back needle bed, and a loop presser bed. The front needle bed includes a plurality of front knitting needles. The back needle beds includes a plurality of back knitting needles at corresponding positions staggered from the front knitting needles. The loop presser bed is above the front needle bed or the back needle bed, and includes a plurality of right-directed knitting pressing pieces and left-directed knitting pressing pieces alternately arranged in gaps of the plurality of front knitting needles and the plurality of back knitting needles, respectively. The double-sided fabric is further embedded with at least one continuous cord material, which is pressed by the plurality of right-directed knitting pressing pieces and the plurality of left-directed knitting pressing pieces into at least one predetermined knitting section to become folded and stacked in the predetermined knitting section.

Further, in the double-sided fabric stacked with the continuous cord material in the predetermined section, the continuous cord material is guided and fed in from the front needle bed towards the double-sided fabric, and guided towards the front needle bed to depart the double-sided fabric.

Further, in the double-sided fabric stacked with the continuous cord material in the predetermined section, the continuous cord material is guided and fed in from the front needle bed towards the double-sided fabric, and guided towards the back needle bed to depart the double-sided fabric.

Further, in the double-sided fabric stacked with the continuous cord material in the predetermined section, the continuous cord material is guided and fed in from the back needle bed towards the double-sided fabric, and guided towards the back needle bed to depart the double-sided fabric.

Further, in the double-sided fabric stacked with the continuous cord material in the predetermined section, the continuous cord material is guided and fed in from the back needle bed towards the double-sided fabric, and guided towards the front needle bed to depart the double-sided fabric.

Further, in the double-sided fabric stacked with the continuous cord material in the predetermined section, the predetermined knitting section is formed by front loops and a back loop switched by at least two front knitting needles and at least one back knitting needle in the same knitting process.

Further, in the double-sided fabric stacked with the continuous cord material in the predetermined section, the predetermined knitting section is formed by a front loop and a back loops switched by at least one front knitting needle and at least two back knitting needles in the same knitting process.

It is known from the above technical solution that, the present invention achieves following effects compared to the prior art. First of all, in the present invention, the continuous cord material can be embedded into the double-sided fabric, such that the double-sided fabric may offer preferred thickness and piling effect. Secondly, in the present invention, the continuous cord material may be embedded in the predetermined knitting section, and a double-sided fabric appearing relief embossed and having different thicknesses is manufactured to satisfy consumer market needs.

DETAILED DESCRIPTION OF THE PREFERRED EMBODIMENTS

First of all, it should be noted that a flat bed knitting machine described in the present invention is a known model (model number: SVR093SP) made by Shima Seiki Mfg., Ltd, Japan. However, this model is not to be construed as a limitation to the present invention. As the above flat bed knitting machine is a technology generally known to one person skilled in the art, the structure of the flat bed knitting machine is described in brief in the application, and associated details and denotations are omitted herein. The flat bed knitting machine at least includes a front needle bed, a back needle bed, a loop presser bed, a carriage above the front needle bed, the back needle bed and the loop presser bed, and a plurality of yarn feeders between the front needle bed, the back needle bed and the loop presser bed. The front needle bed includes a plurality of front knitting needles. The back needle bed includes a plurality of back knitting needles at corresponding positions staggered from the front knitting needles. The loop presser bed is above the front needle bed or the back needle bed, and includes a plurality of right-directed knitting pressing pieces and a plurality of left-directed knitting pressing pieces correspondingly and alternately arranged in gaps of the plurality of front knitting needles and the plurality of back knitting needles, respectively. Technical details of the double-sided fabric stacked with a continuous cord material in a predetermined knitting section according to preferred embodiments of the present invention are given with the accompanying drawings below.

Figure 1:
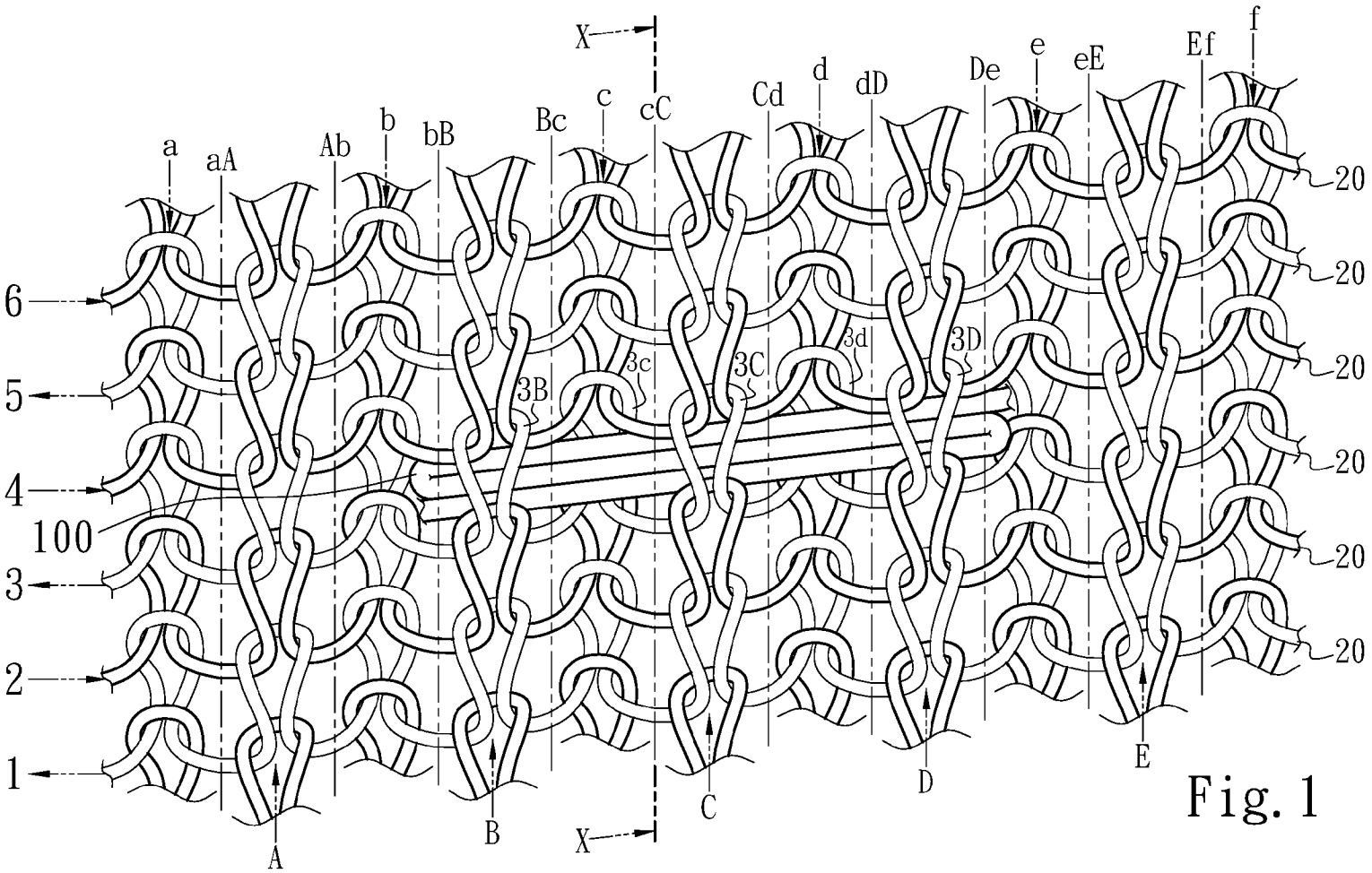
FIG. 1 is a partial planar structural schematic diagram according to a first preferred embodiment of the present invention.
Figure 2:
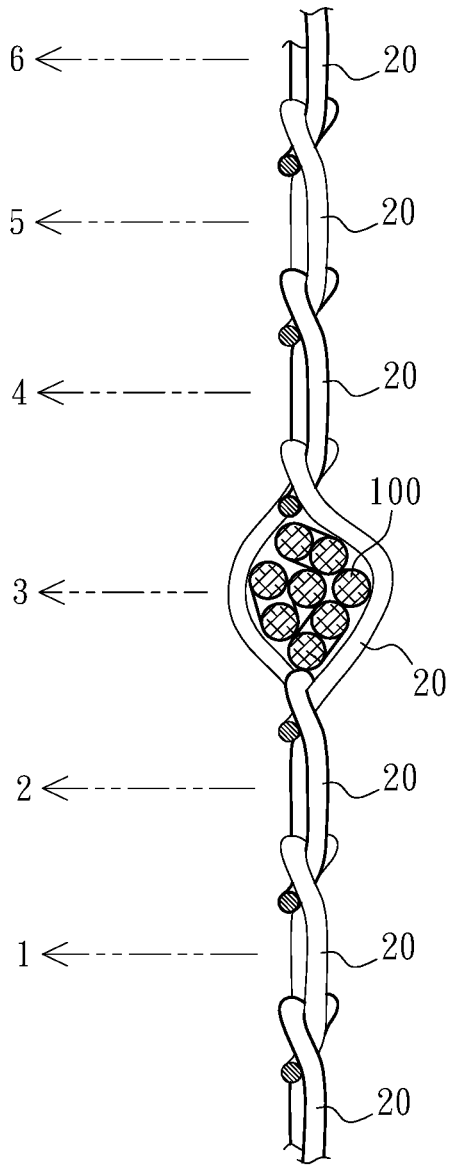
FIG. 2 is a planar section diagram along X-X in FIG. 1.
Figure 3:
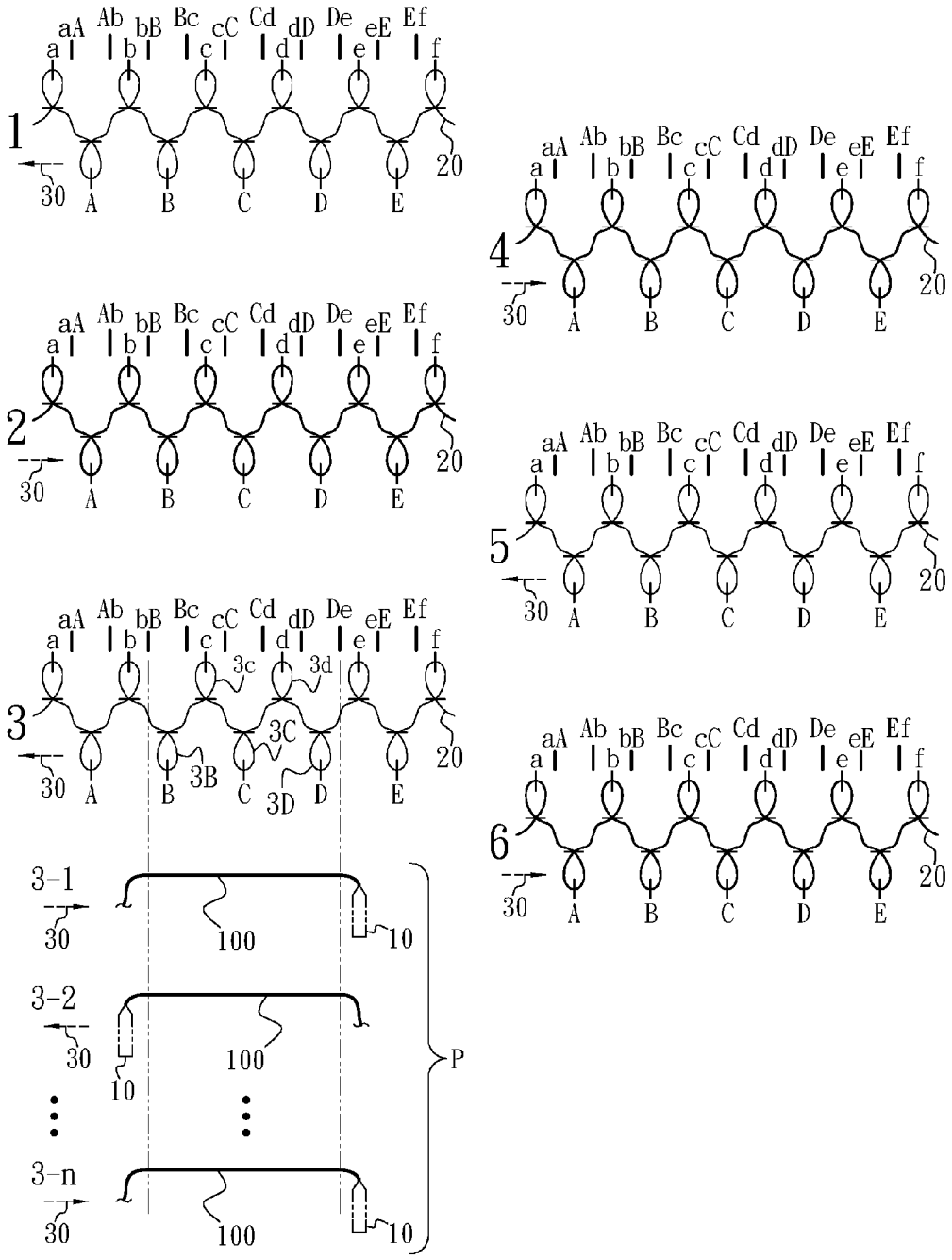
FIG. 3 is a diagram of partial knitting processes of FIG. 1.
Figure 4:
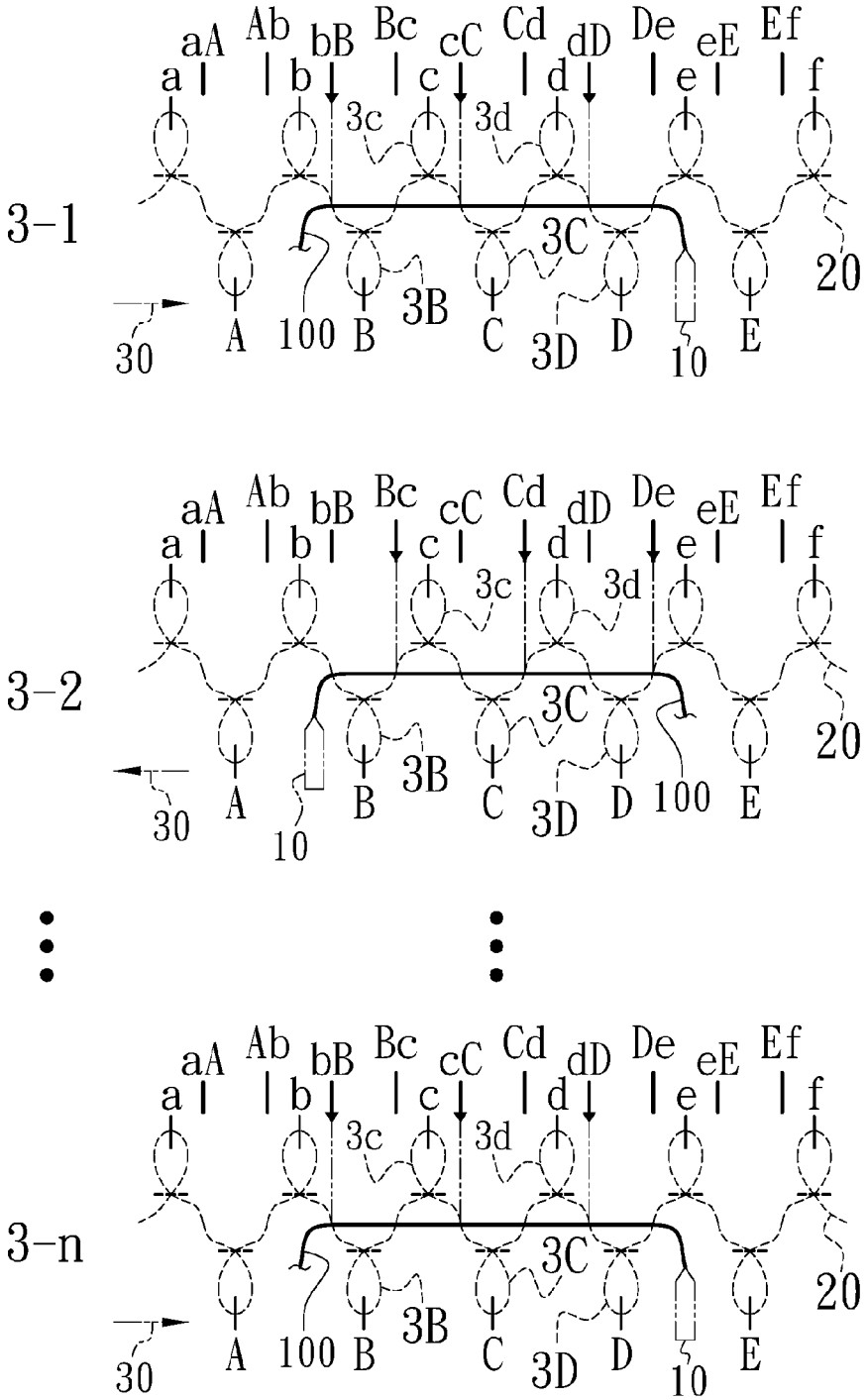
FIG. 4 is a detailed diagram of a symbol P in FIG. 3.
Figure 5:
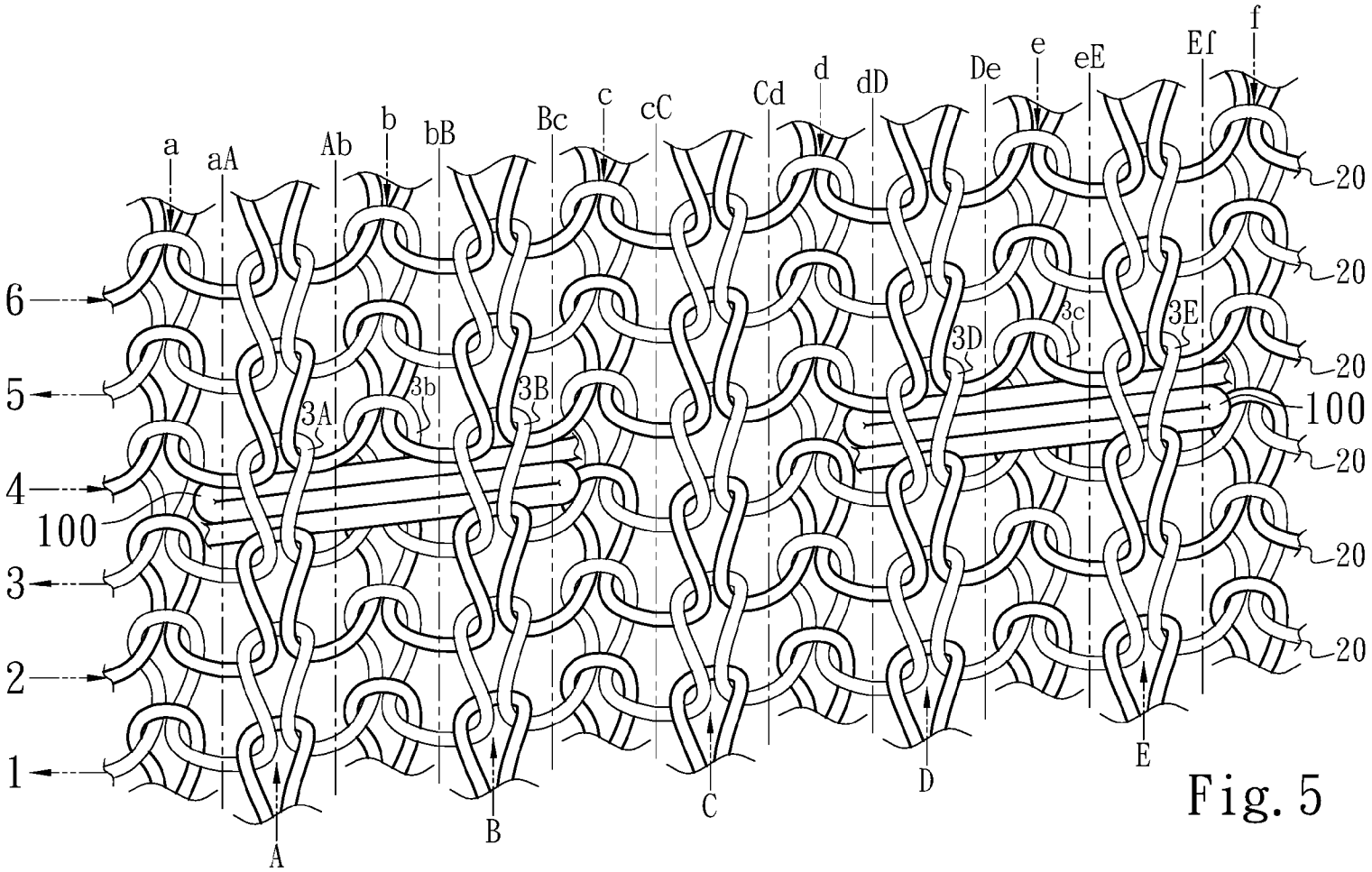
FIG. 5 is a partial planar structural schematic diagram according to a second preferred embodiment of the present invention.
Figure 6:
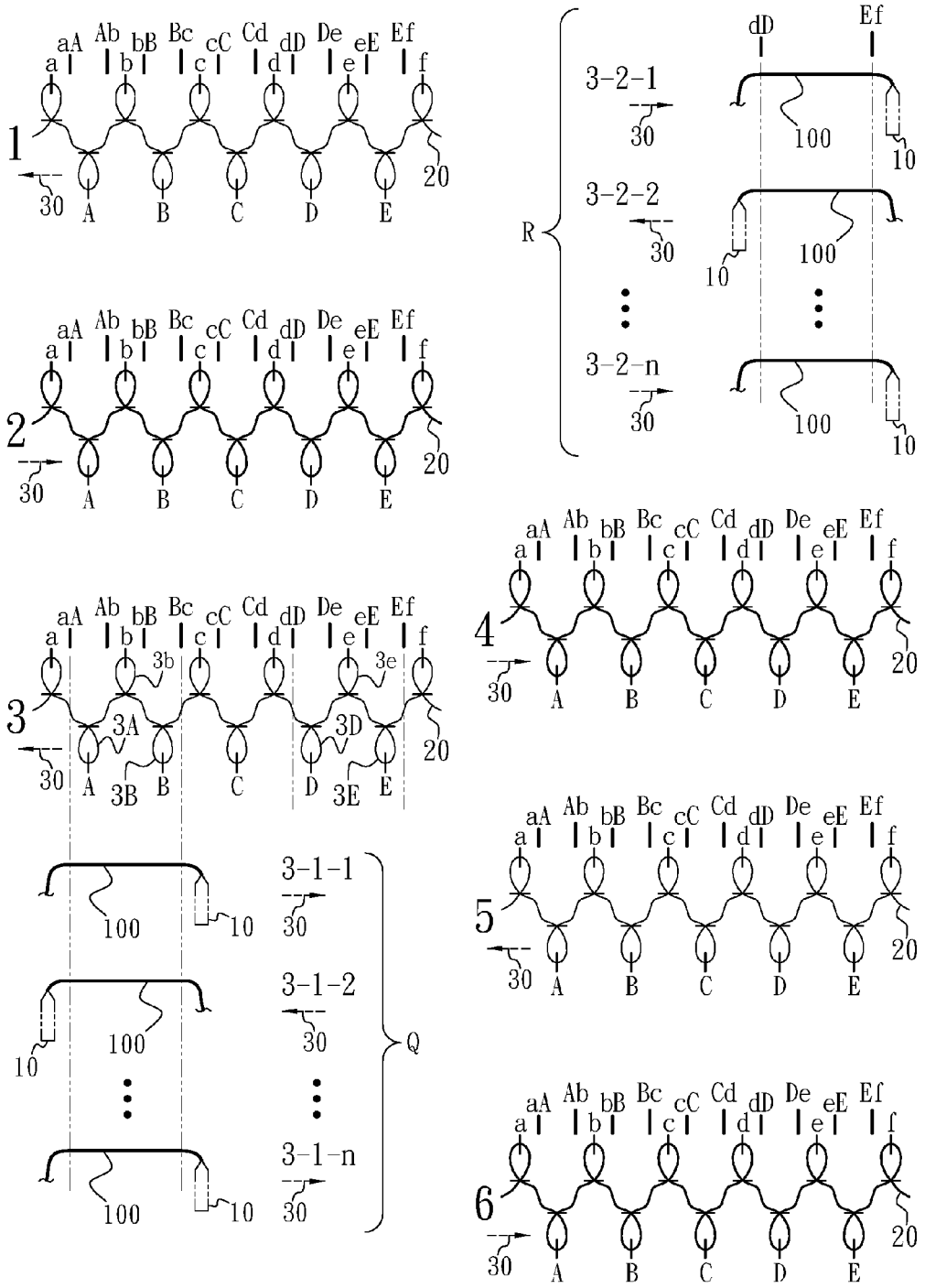
FIG. 6 is a diagram of partial knitting processes of FIG. 5.

FIG. 1 and FIG. 2 show a partial planar structural schematic diagram and a planar section diagram along X-X according to a first embodiment of the present invention. It is clearly seen from the diagrams that, a double-sided fabric stacked with a continuous cord material in a predetermined section according to the first preferred embodiment of the present invention is knit from a face yarn 20 by the above flat bed knitting machine. The front needle bed includes a plurality of front knitting needles A to E. The back needle bed includes a plurality of back knitting needles a to f at corresponding position staggered from the plurality of front knitting needles A to E. The loop presser bed is above the front needle bed or the back needle bed, and includes a plurality of right-directed knitting pressing pieces aA, bB, cC, dD and eE and a plurality of left-directed knitting pressing pieces Ef, De, Cd, Bc and Ab correspondingly alternately arranged in gaps of the plurality of front knitting needles A to E and the plurality of back knitting needles a to f, respectively. The double-sided fabric is embedded with a continuous cord material 100, which is pressed by the plurality of right-directed knitting pressing pieces bB, cC and dD and the plurality of left-directed knitting pressing pieces De, Cd and Bc into a predetermined knitting section (consisted of a front loop 3B, a back loop 3*c*, a front loop 3C, a back loop 3*d* and a front loop 3D formed from stitching the face yarn 20 by the front knitting needles B, C and D and the back knitting needles c and d in a same knitting process), such that the continuous cord material 100 becomes folded and stacked in the predetermined knitting section (the front loop 3B, the back loop 3*c*, the front loop 3C, the back loop 3*d* and the front loop 3D). It should be noted that, the continuous cord material 100 may be guided and fed in from the front needle bed towards the double-sided fabric, and guided towards the back needle bed to depart the double-sided fabric. Alternatively, the continuous cord material 100 may be guided and fed in from the front needle bed towards the double-sided fabric, and guided towards the back needle bed to depart the double-sided fabric. Similarly, the continuous cord material 100 may be guided and fed in from the back needle bed towards the double-sided fabric, and guided towards the back needle bed to depart the double-sided fabric. Alternatively, the continuous cord material 100 may be guided and fed in from the back needle bed towards the double-sided fabric, and guided towards the front needle bed to depart the double-sided fabric. To better understand the present invention, further details are given below with reference to FIG. 3 and FIG. 4 showing a diagram of partial knitting processes and a detailed diagram of a symbol P according to the first preferred embodiment of the present invention. Referring to FIG. 3, when the flat bed knitting machine applied in the present invention starts knitting along a carriage operation direction 30 to the left side as shown, the back knitting needles f to a and the front knitting needles E to A sequentially stitch the face yarn 20 to form loops, as shown by the knitting process 1. After knitting is next performed along the carriage operation direction 30 to the right side, the front knitting needles A to E and the back knitting needles a to f sequentially stitch the face yarn 20 to form loops, as shown by the knitting process 2 in FIG. 3. After knitting is next performed along the carriage operation direction 30 to the left side, the back knitting needles f to a and the front knitting needles E to A sequentially stitch the face yarn 20 to form loops, as shown by the knitting process 3 in FIG. 3. At this point, the operator has set to embed a continuous cord material 100 into the predetermined knitting section (the front loop 3B, the back loop 3*c*, the front loop 3C, the back loop 3*d* and the front loop 3D). Further refer to FIG. 4 showing a detailed diagram of the simplified knitting process diagram P in FIG. 3. At this point, the front knitting needles A to E and the back knitting needles a to f are controlled to stop knitting, and a yarn feeder 10 is caused to guide and feed the continuous cord material 100 from between the front knitting needles A and B of the front needle bed and further guide the continuous cord material 100 from the left side to the right side above the predetermined knitting section (the front loop 3B, the back loop 3*c*, the front loop 3C, the back loop 3*d* and the front loop 3D), to cause the carriage operation direction 30 to move to the right side along with the operation direction of the yarn feeder 10. Further, the right-directed knitting pressing pieces bB, cC and dD are controlled to sequentially press the continuous cord material 100 downwards into the predetermined knitting section (the front loop 3B, the back loop 3*c*, the front loop 3C, the back loop 3*d* and the front loop 3D). Thus, When the yarn feeder 10 reaches the back knitting needle e, the yarn feeder 10 stops guiding to the right side, as shown by the knitting process 3-1. Next, the yarn feeder 10 switches to guide the continuous cord material 100 to the left side to cause the continuous cord material 100 to be folded, and again causes the carriage operation direction 30 to move to the left side along with the operation direction of the yarn feeder 10. Further, the left-directed knitting pressing pieces De, Cd and Bc are controlled to sequentially press the continuous cord material 100 downwards into the predetermined knitting section (the front loop 3B, the back loop 3*c*, the front loop 3C, the back loop 3*d* and the front loop 3D). When about to sequentially press downwards, the left-directed knitting pressing pieces De, Cd and Bc sequentially lift the right-directed knitting pressing pieces dD, cC and bB before sequentially passing the right-directed knitting pressing pieces dD, cB and bB to disengage from the continuous cord material 100. When the yarn feeder 10 reaches the back knitting needle b, the yarn feeder 10 stops the guiding to the left side, as shown by the knitting process 3-2. Similarly, the yarn feeder 10 may keep guiding the continuous cord material 100 back and forth to the left and right sides, such that the continuous cord material 100 is continually pressed downwards to become stacked in the predetermined knitting section (the front loop 3B, the back loop 3*c*, the front loop 3C, the back loop 3*d* and the front loop 3D) till the number of stacked segments reaches a required number, as shown in the planar section schematic diagram along X-X in FIG. 2, i.e., equivalently till the number predetermined by the operator is reached, as shown by the knitting process 3-*n* (where n is a predetermined number greater than 2). It should be noted that, because the predetermined knitting section (the front loop 3B, the back loop 3*c*, the front loop 3C, the back loop 3*d* and the front loop 3D) has a limited space for accommodating the continuous cord material 100, the value n may be determined according to the thickness of the continuous cord material 100. Again referring to FIG. 3, after knitting again begins along the carriage operation direction 30 to the right side, the front knitting needles A to E and the back knitting needles a to f sequentially stitch the face yarn 20 to form loops, as shown by the knitting process 4. Further, after knitting is next performed along the carriage operation direction 30 to the left side, the back knitting needles f to a and the front knitting needles E to A sequentially stitch the face yarn 20 to form loops, as shown by the knitting process in FIG. 5. Finally, after knitting again begins along the carriage operation direction 30 to the right side, the front knitting needles A to E and the back knitting needles a to f sequentially stitch the face yarn 20 to form loops, as shown by the knitting process 6 in FIG. 3.

Figure 7:
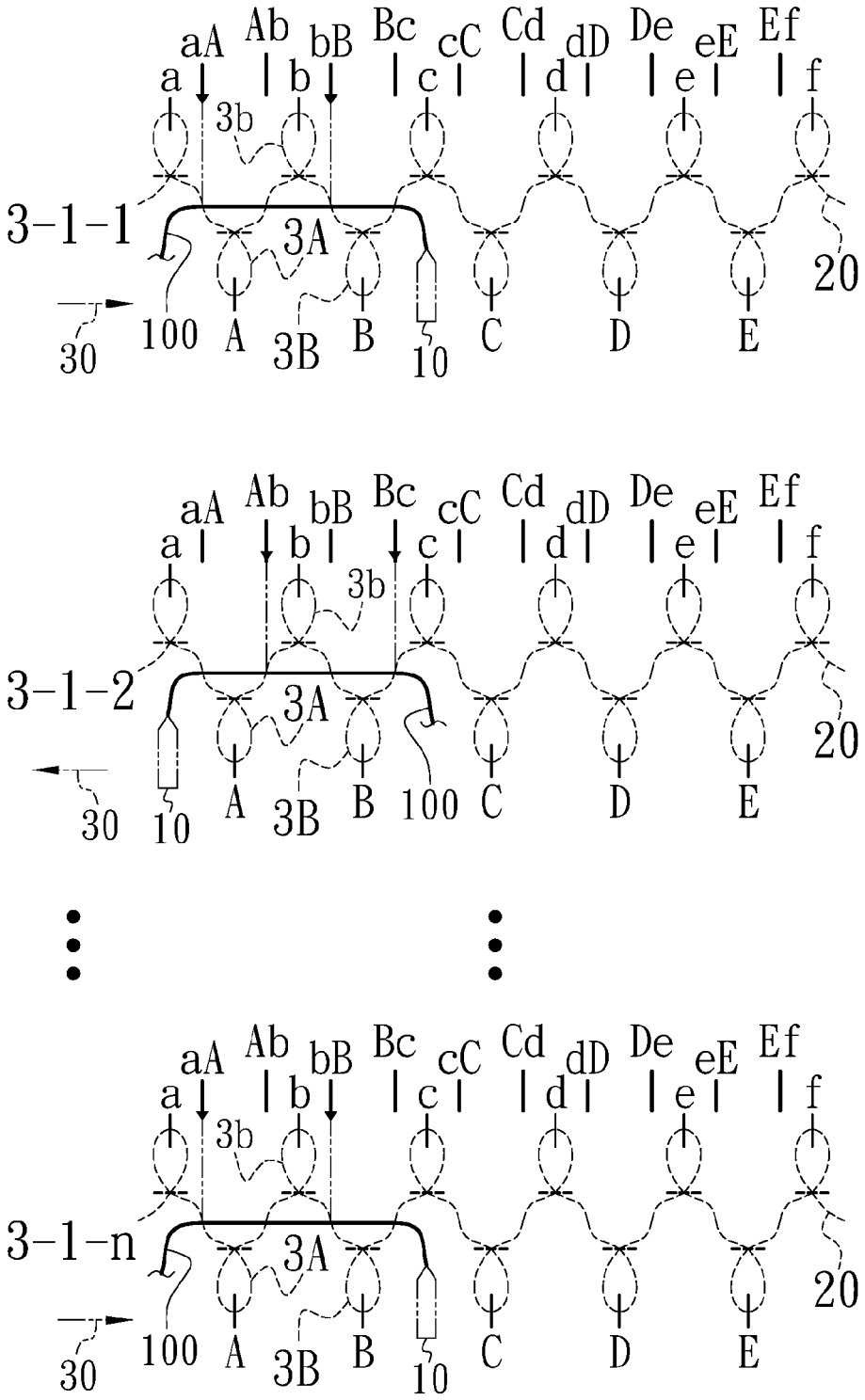
FIG. 7 is a detailed diagram of a symbol Q in FIG. 6.
Figure 8:
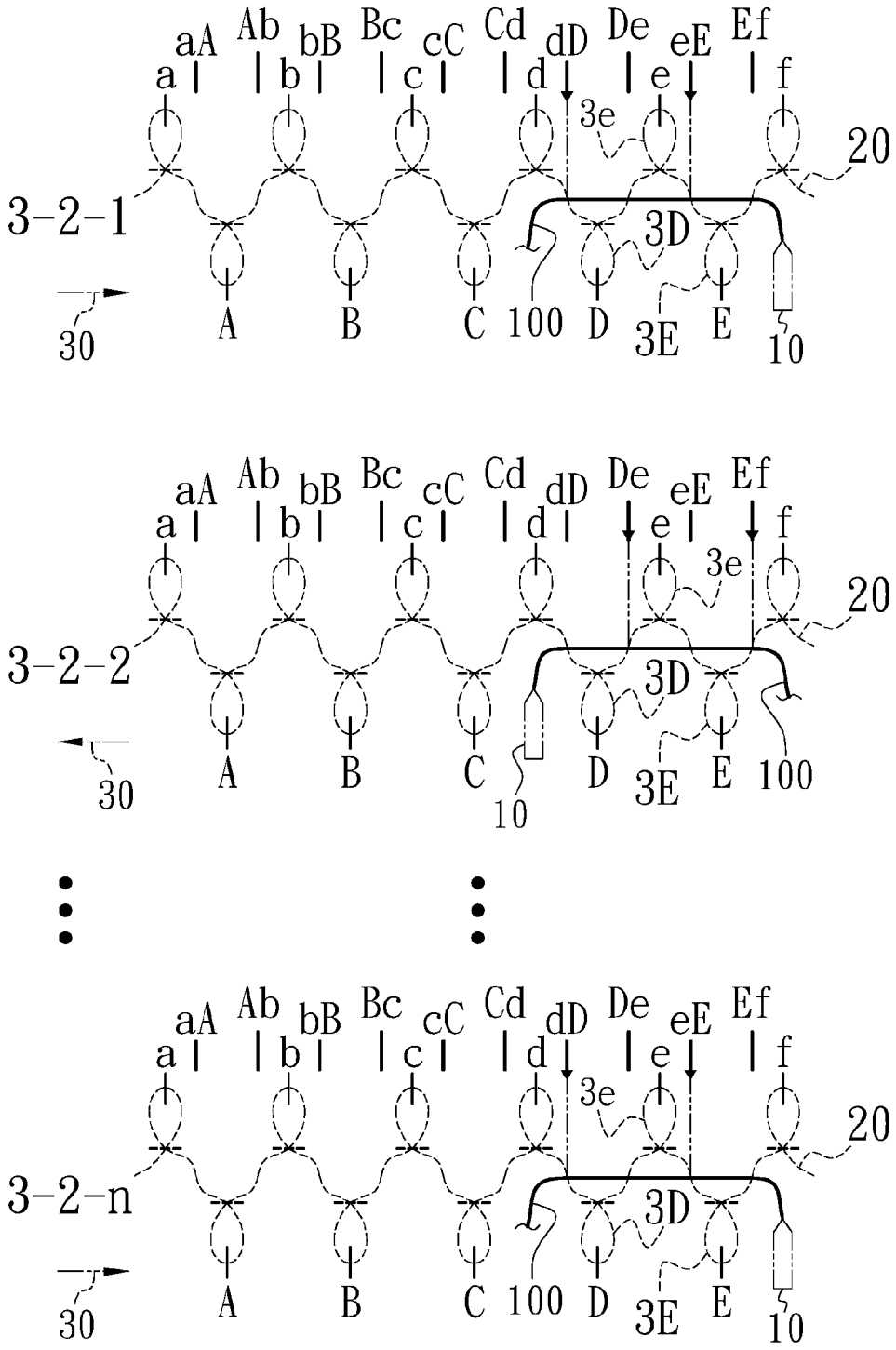
FIG. 8 is a detailed diagram of a symbol R in FIG. 6.

FIG. 5 to FIG. 8 show a partial planar structural schematic diagram, a diagram of partial knitting processes, and detailed diagrams of symbols Q and R in the diagram of partial knitting processes according to a second preferred embodiment of the present invention. When the flat bed knitting machine applied in the present invention starts knitting along the carriage operation direction 30 to the left side as shown by the knitting process 1 in FIG. 6, the back knitting needles f to a and the front knitting needles E to A sequentially stitch the face yarn 20 to form loops. After knitting is performed along the carriage operation direction 30 to the right side, the front knitting needles A to E and the back knitting needles a to f sequentially stitch the face yarn 20 to form loops, as shown by the knitting process 2 in FIG. 6. Further, after knitting is next performed along the carriage operation direction 30 to the left side, the back knitting needles f to a and the front knitting needles E to A sequentially stitch the face yarn 20 to form loops, as shown by the knitting process 3 in FIG. 6. At this point, the operator has set to embed a continuous cord material 100 into a predetermined knitting section (consisted of a front loop 3A, a back loop 3*b* and a front loop 3B formed from stitching the face yarn 20 by the front knitting needles A and B and the back knitting needle b in the same knitting process 3). Further refer to FIG. 7 showing a detailed diagram of the simplified knitting process diagram Q in FIG. 6. At this point, the front knitting needles A to E and the back knitting needles a to f are first controlled to stopping knitting, and a yarn feeder 10 is caused to guide and feed the continuous cord material 100 from before the front knitting needle A of the front needle bed and further guide the continuous cord material 100 from the left side to the right side above the predetermined knitting section (the front loop 3A, the back loop 3*b* and the front loop 3B), to cause the carriage operation direction 30 to move to the right side along with the operation direction of the yarn feeder 10. Further, the right-directed knitting pressing pieces aA and bB are controlled to sequentially press the continuous cord material 100 downwards into the predetermined knitting section (the front loop 3A, the back loop 3*b* and the front loop 3B). Thus, When the yarn feeder 10 reaches the back knitting needle c, the yarn feeder 10 stops guiding to the right side, as shown by the knitting process 3-1-1. Next, the yarn feeder 10 switches to guide the continuous cord material 100 to the left side to cause the continuous cord material 100 to be folded, and again causes the carriage operation direction 30 to move to the left side along with the operation direction of the yarn feeder 10. Further, the left-directed knitting pressing pieces Bc and Ab are controlled to sequentially press the continuous cord material 100 downwards into the predetermined knitting section (the front loop 3A, the back loop 3*b* and the front loop 3B). When about to sequentially press downwards, the left-directed knitting pressing pieces Bc and Ab sequentially lift the right-directed knitting pressing pieces bB and aA to disengage from the continuous cord material 100 before sequentially passing the right-directed knitting pressing pieces bB and aA. When the yarn feeder 10 reaches the back knitting needle a, the yarn feeder 10 stops guiding to the left side, as shown by the knitting process 3-1-2. Similarly, the yarn feeder 10 may keep guiding the continuous cord material 100 back and forth to the left and right sides, such that the continuous cord material 100 is continually pressed downwards to become stacked in the predetermined knitting section (the front loop 3A, the back loop 3*b* and the front loop 3B) till the number of stacked segments reaches a required number, i.e., equivalently till the number predetermined by the operator is reached, as shown by the knitting process 3-1-*n* (where n is a predetermined number greater than 2). The operator has further set to embed the continuous cord material 100 into another predetermined knitting section (consisted of a front loop 3D, a back loop 3*e* and a front loop 3E formed from stitching the face yarn 20 by the front knitting needles D and E and the back knitting needle e in the same knitting process 3). Further refer to FIG. 8 showing a detailed diagram of the simplified knitting process diagram R in FIG. 6. At this point, the front knitting needles A to E and the back knitting needles a to f are still controlled to stopped knitting, and the yarn feeder 10 is caused to guide the feed the continuous cord material 100 from between the front knitting needles C and D of the front needle bed and further guide the continuous cord material 100 from the left side to the right side above the predetermined knitting section (the front loop 3D, the back loop 3*e* and the front loop 3E), to cause the carriage operation direction 30 to move to the right side along with the operation direction of the yarn feeder 10. Further, the right-directed knitting pressing pieces dD and eE are controlled to sequentially press the continuous cord material 100 downwards into the predetermined knitting section (the front loop 3D, the back loop 3*e* and the front loop 3E). Thus, the yarn feeder 10 stops guiding to the right side when the yarn feeder 10 reaches the back knitting needle f, as shown by the knitting process 3-2-1. Next, the yarn feeder 10 switches to guide the continuous cord material 100 to the left side to cause the continuous cord material 100 to be folded, and again causes the carriage operation direction 30 to move to the left side along with the operation direction of the yarn feeder 10. Further, the left-directed knitting pressing pieces Ef and De are controlled to press the continuous cord material 100 downwards into the predetermined knitting section (the front loop 3D, the back loop 3*e* and the front loop 3E). When about to sequentially press downwards, the left-directed knitting pressing pieces Ef and De sequentially lift the right-directed knitting pressing pieces eE and dD to disengage from the continuous cord material 100 before sequentially passing the right-directed knitting pressing pieces eE and dD. When the yarn feeder 10 reaches the back knitting needle d, the yarn feeder 10 stops guiding to the left side, as shown by the knitting process 3-2-2. Similarly, the yarn feeder 10 may keep guiding the continuous cord material 100 back and forth to the left and right sides, such that the continuous cord material 100 is continually pressed downwards to become stacked in the predetermined knitting section (the front loop 3D, the back loop 3*e* and the front loop 3E) till the number of stacked segments reaches a required number, i.e., equivalently till the number predetermined by the operator is reached, as shown by the knitting process 3-2-*n* (where n is a predetermined number greater than 2). Next, again referring to FIG. 6, after knitting is again performed along the carriage operation direction 30 to the right side, the front knitting needles A to E and the back knitting needles a to f sequentially stitch the face yarn 20 to form loops, as shown by the knitting process 4. Further, after knitting is next performed along the carriage operation direction 30 to the left side, the back knitting needles f to a and the front knitting needles E to A sequentially stitch the face yarn 20 to form loops, as shown by the knitting process 5 in FIG. 6. Finally, after knitting is again performed along the carriage operation direction 30 to the right side, the front knitting needles A to E and the back knitting needles a to f sequentially stitch the face yarn 20 to form loops, as shown by the knitting process 6 in FIG. 6.

Figure 9:
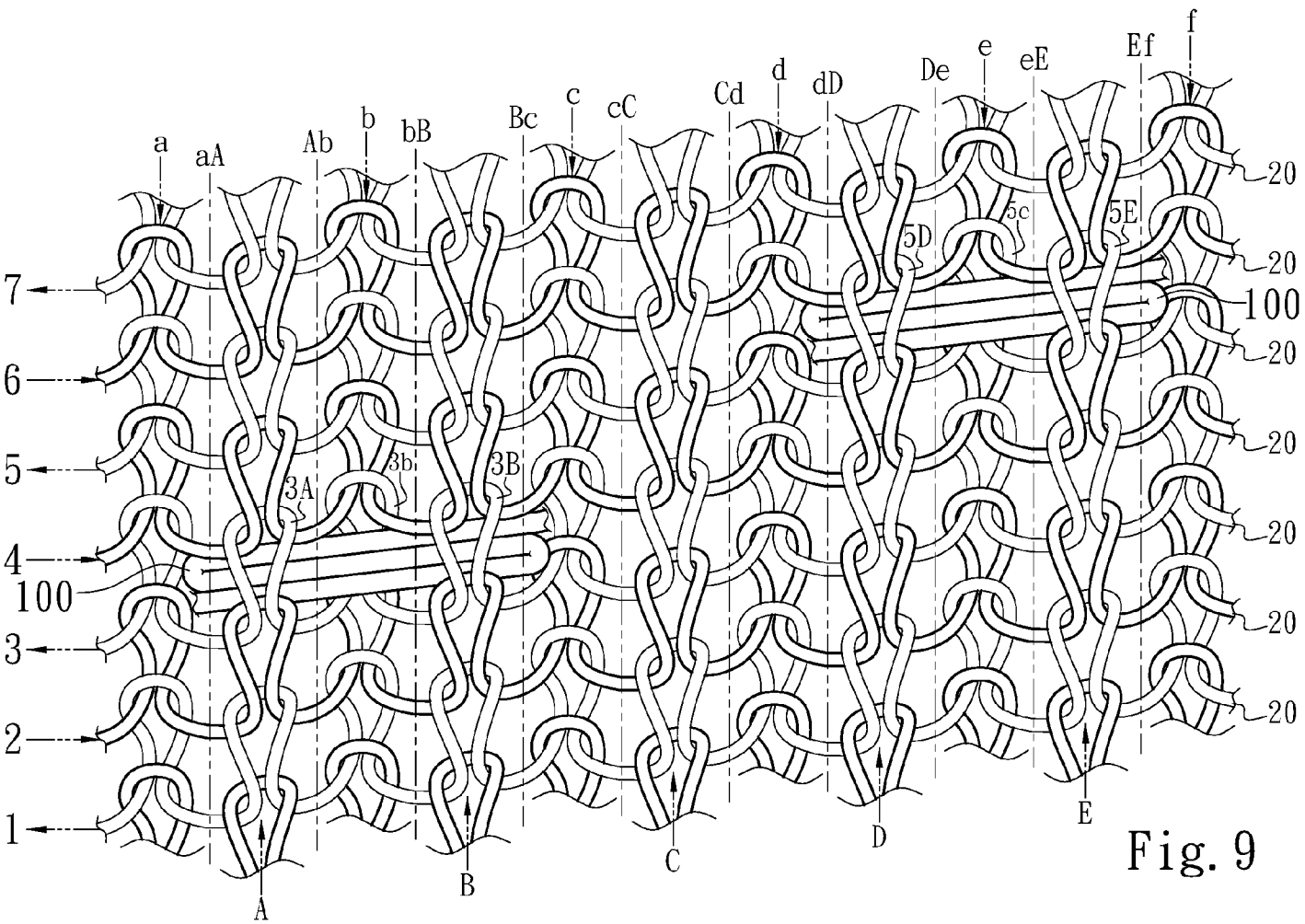
FIG. 9 is a partial planar structural schematic diagram according to a third preferred embodiment of the present invention.
Figure 10:
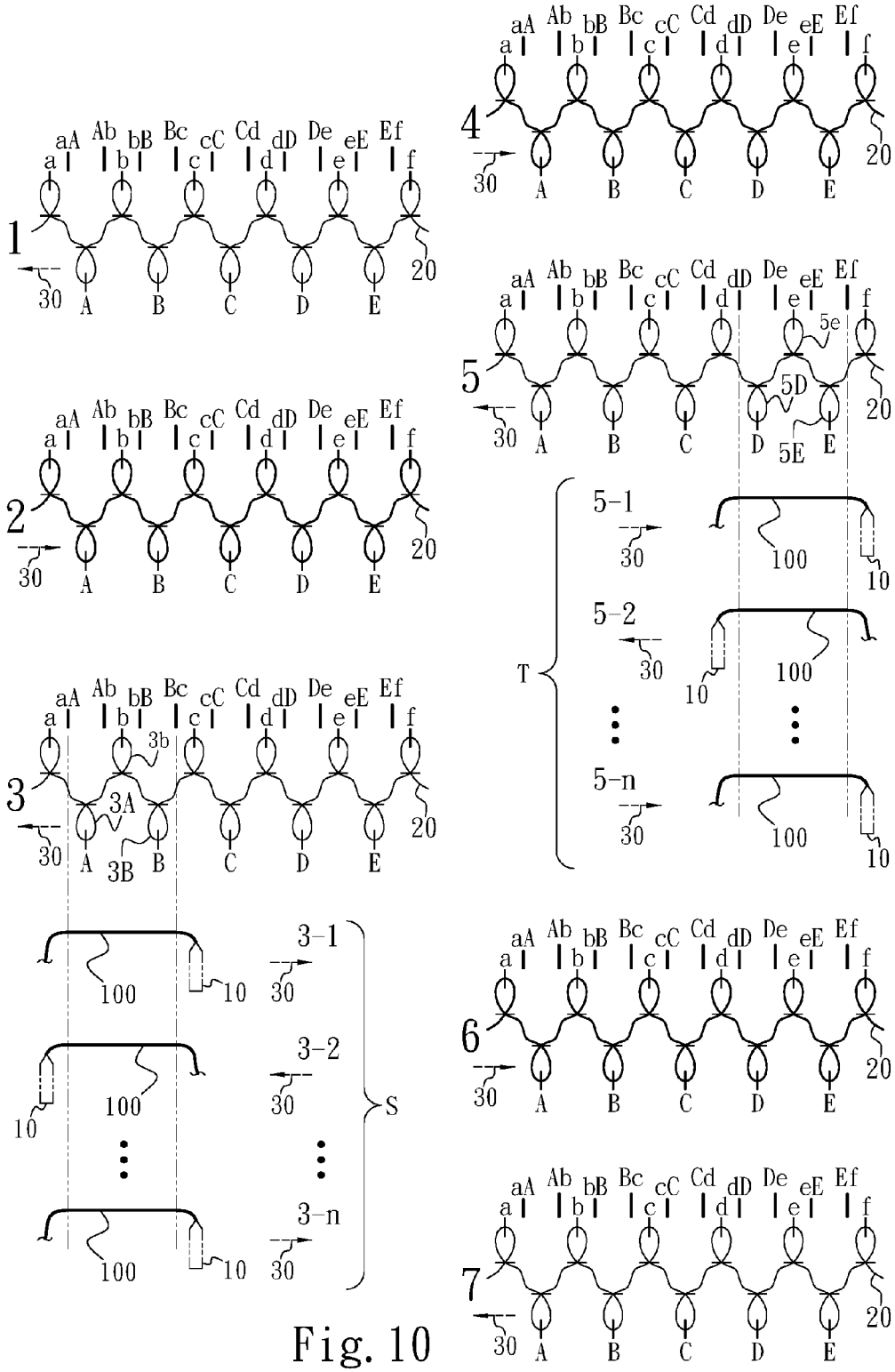
FIG. 10 is a diagram of partial knitting processes of FIG. 9.
Figure 11:
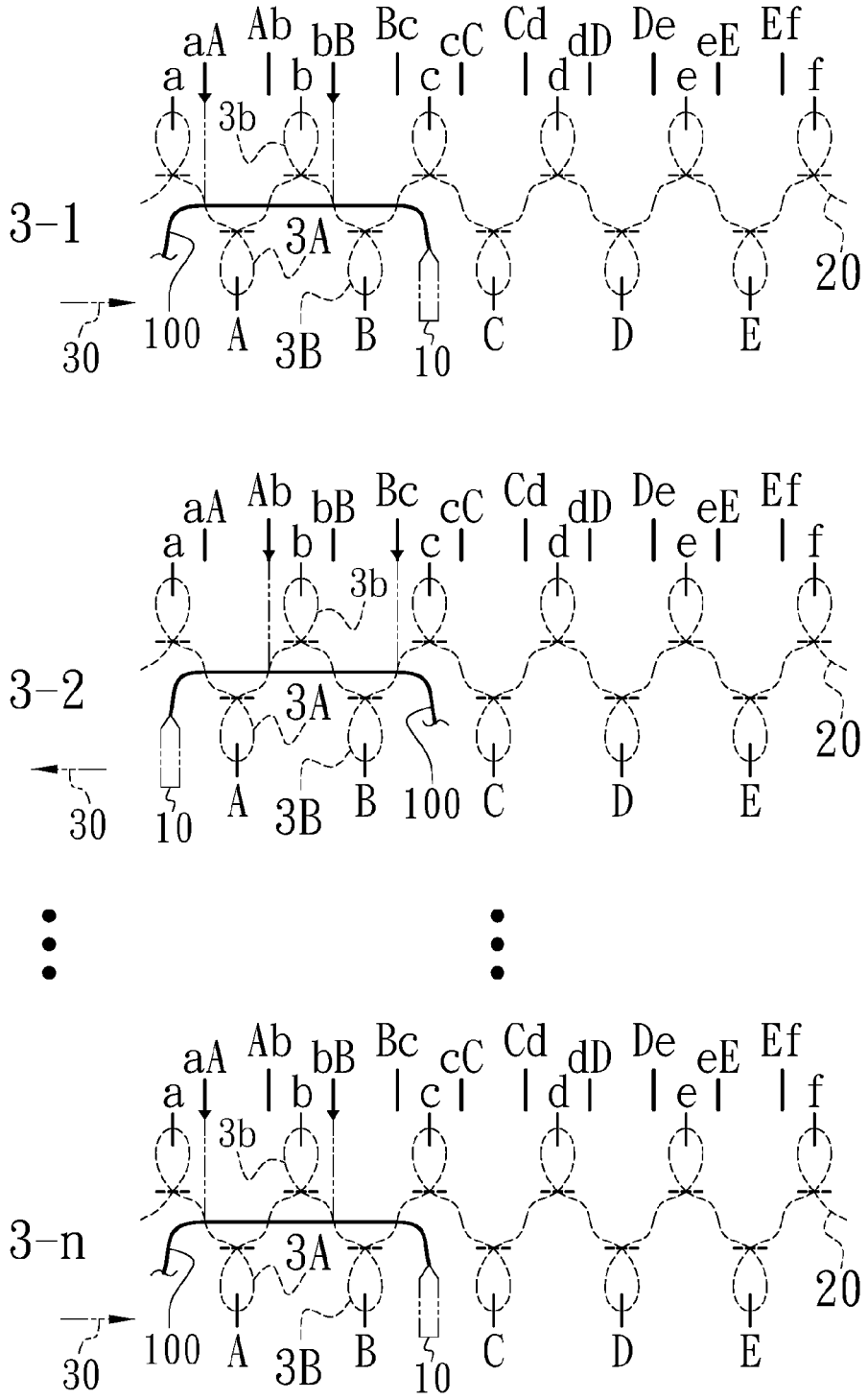
FIG. 11 is a detailed diagram of a symbol S in FIG. 10.
Figure 12:
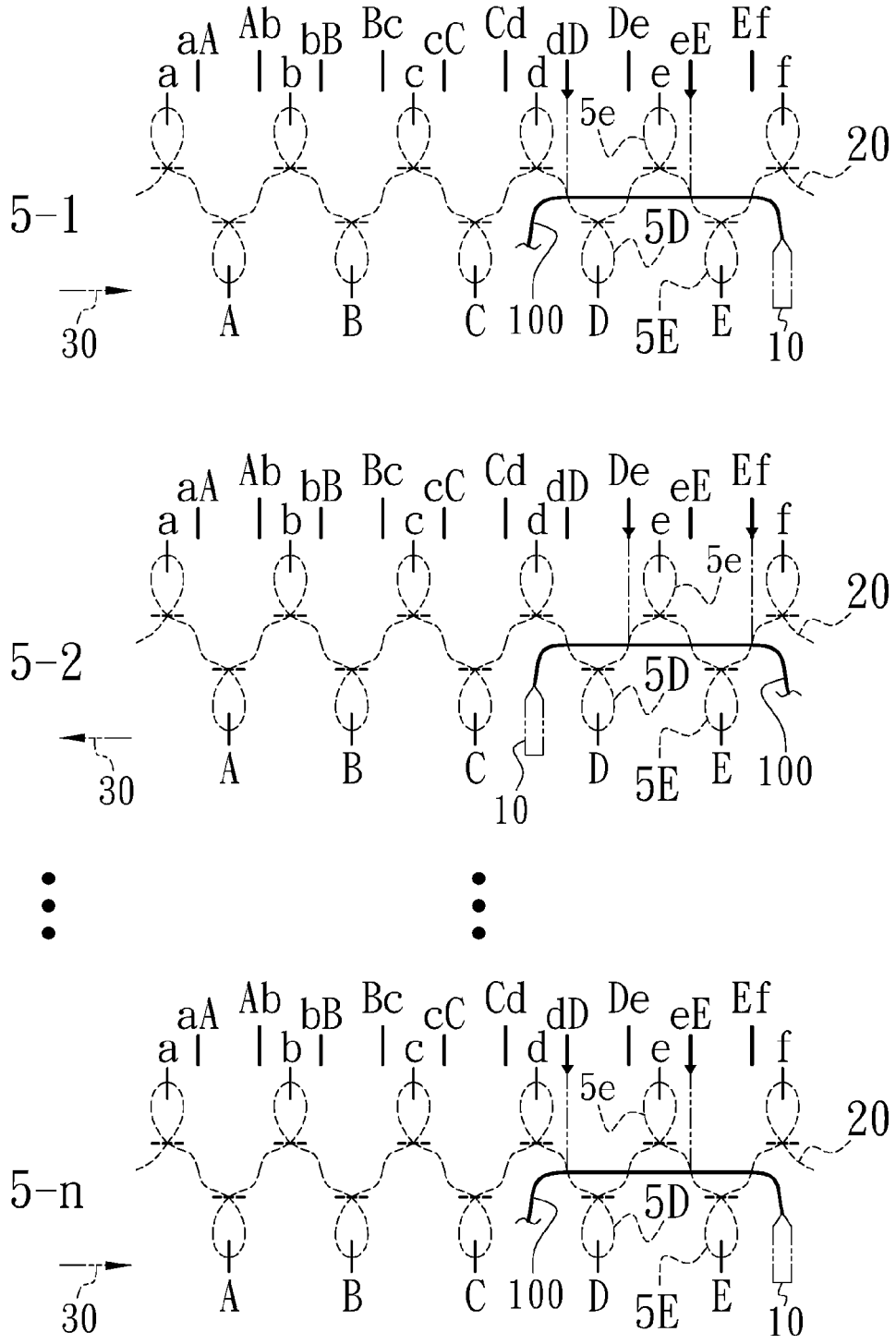
FIG. 12 is a detailed diagram of a symbol T in FIG. 10.
Figure 13:
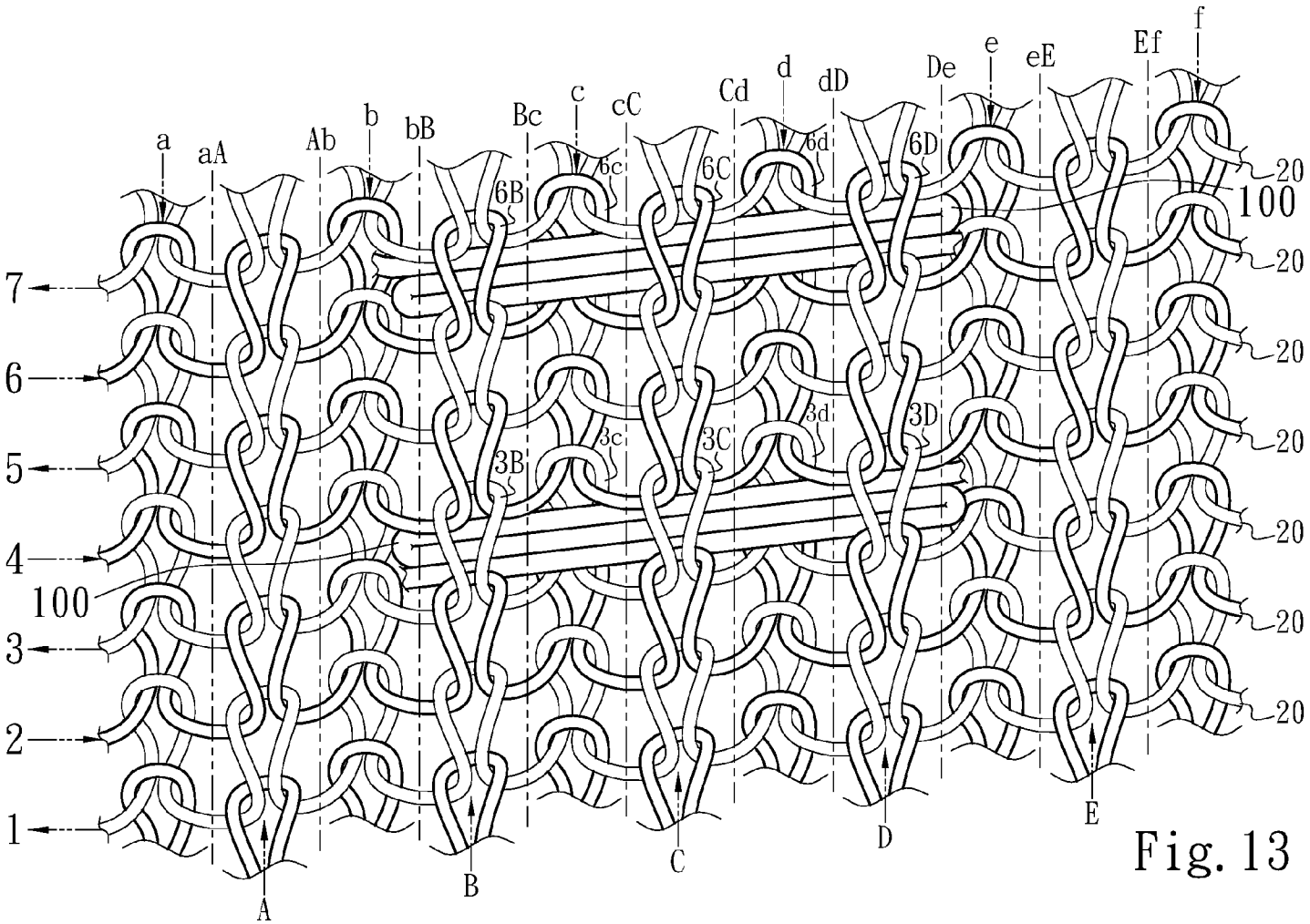
FIG. 13 is a partial planar structural schematic diagram according to a fourth preferred embodiment of the present invention.
Figure 14:
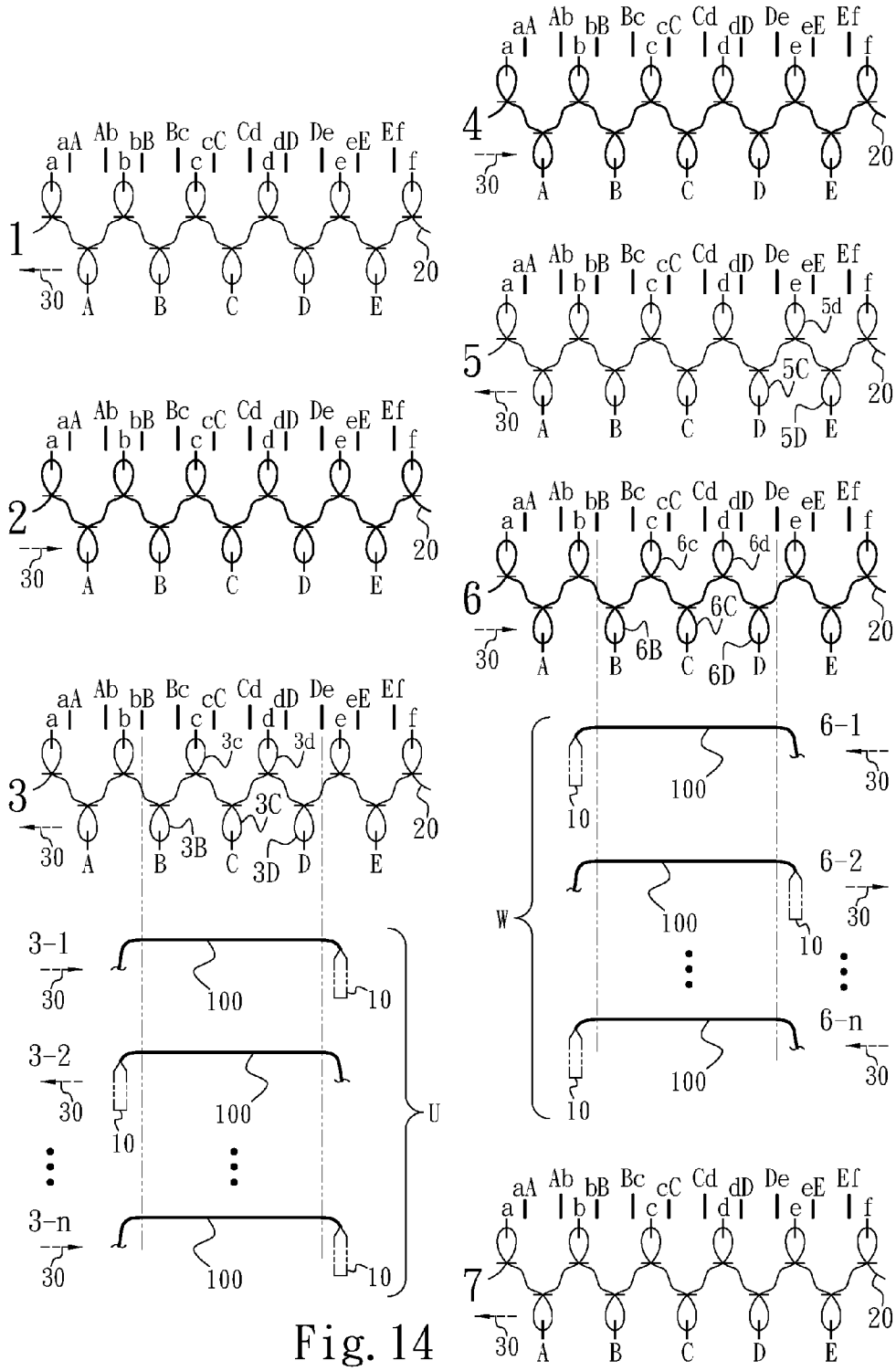
FIG. 14 is a diagram of partial knitting processes of FIG. 13.

FIG. 9 to FIG. 12 show a partial planar structural schematic diagram, a diagram of partial knitting processes, and detailed diagrams of symbols S and T in the diagram of partial knitting processes according to a third preferred embodiment of the present invention. When the flat bed knitting machine applied in the present invention starts knitting along the carriage operation direction 30 to the left side as shown by the knitting process 1 in FIG. 10, the back knitting needles f to a and the front knitting needles E to A sequentially stitch the face yarn 20 to form loops. After knitting is next performed along the carriage operation direction 30 to the right side, the front knitting needles A to E and the back knitting needles a to f sequentially stitch the face yarn 20 to form loops, as shown by the knitting process 2 in FIG. 10. Further, after knitting is next performed along the carriage operation direction 30 to the left side, the back knitting needles f to a and the front knitting needles E to A sequentially stitch the face yarn 20 to form loops, as shown by the knitting process 3 in FIG. 10. At this point, the operator has set to embed a continuous cord material 100 into a predetermined knitting section (consisted of a front loop 3A, a back loop 3*b* and a front loop 3B formed from stitching the face yarn 20 by the front knitting needles A and B and the back knitting needle b in the same knitting process 3). Further refer to FIG. 11 showing a detailed diagram of the simplified knitting process diagram S in FIG. 10. At this point, the front knitting needles A to E and the back knitting needles a to f are controlled to stop knitting, and a yarn feeder 10 is caused to guide and feed the continuous cord material 100 from before the front knitting needle A of the front needle bed, and further guide the continuous cord material 100 from the left side to the right side above the predetermined knitting section (the front loop 3A, the back loop 3*b* and the front loop 3B), to cause the carriage operation direction 30 to move to the right side along with the operation direction of the yarn feeder 10. Further, the right-directed knitting pressing pieces aA and bB are controlled to sequentially press the continuous cord material 100 downwards into the predetermined knitting section (the front loop 3A, the back loop 3*b* and the front loop 3B). Thus, when the yarn feeder 10 reaches the back knitting needle c, the yarn feeder 10 stops the guiding to the right side, as shown by the knitting process 3-1. Next, the yarn feeder 10 switches to guide the continuous cord material 100 to the left side to cause the continuous cord material 100 to be folded, and again causes the carriage operation direction 30 to move to the left side along with the operation direction of the yarn feeder 10. Further, the left-directed knitting pressing pieces Bc and Ab are controlled to again sequentially press the continuous cord material 100 downwards into the predetermined knitting section (the front loop 3A, the back loop 3*b* and the front loop 3B). When about to sequentially press downwards, the left-directed knitting pressing pieces Bc and Ab sequentially lift the right-directed knitting pressing pieces bB and aA to disengage from the continuous cord material 100 before sequentially passing the right-directed knitting pressing pieces bB and aA. When the yarn feeder 10 reaches the back knitting needle a, the yarn feeder 10 stops guiding to the left side, as shown by the knitting process 3-2. Similarly, the yarn feeder 10 may keep guiding the continuous cord material 100 back and forth to the left and right sides, such that the continuous cord material 100 is continually pressed downwards to become stacked in the predetermined knitting section (the front loop 3A, the back loop 3*b* and the front loop 3B) till the number of stacked segments reaches a required number, i.e., equivalently till the number predetermined by the operator is reached, as shown by the knitting process 3-*n* (where n is a predetermined number greater than 2). Again referring to FIG. 10, after knitting is again performed along the carriage operation direction 30 to the right side, the front knitting needles A to E and the back knitting needles a to f sequentially stitch the face yarn 20 to form loops, as shown by the knitting process 4. Further, after knitting is next performed along the carriage operation direction 30 to the left side, the back knitting needles f to a and the front knitting needles E to A sequentially stitch the face yarn 20 to form loops, as shown by the knitting process 5 in FIG. 10. At this point, the operator has further set to embed the continuous cord material 100 into another knitting section (consisted of a front loop 5D, a back loop 5*e* and a front loop 5E formed from stitching the face yarn 20 by the front knitting needles D and E and the back knitting needle e in the same knitting process 5), as shown in FIG. 9. Further refer to FIG. 12 showing a detailed diagram of the simplified knitting process diagram T in FIG. 10. At this point, the front knitting needles A to E and the back knitting needles a to f are first controlled to stop knitting, and the yarn feeder 10 is caused to guide and feed the continuous cord material 100 from between the front knitting needles C and D of the front needle bed and further guide the continuous cord material 100 from the left side to the right side above the predetermined knitting section (the front loop 5D, the back loop 5*e* and the front loop 5E) to cause the carriage operation direction 30 to move to the right side along with the operation direction of the yarn feeder 10. Further, the right-directed knitting pressing pieces dD and eE are controlled to sequentially press the continuous cord material 100 downwards into the predetermined knitting section (the front loop 5D, the back loop 5*e* and the front loop 5E), to cause the yarn feeder 10 to stop guiding to the right side when the yarn feeder 10 reaches the back knitting needle f, as shown by the knitting process 5-1. Next, the yarn feeder 10 switches to guide the continuous cord material 100 to the left side to cause the continuous cord material 100 to be folded, and again causes the carriage operation direction 30 to move to the left side along with the operation direction of the yarn feeder 10. Further, the left-directed knitting pressing pieces Ef and De are controlled to again sequentially press the continuous cord material 100 downwards into the predetermined knitting section (the front loop 5D, the back loop 5*e* and the front loop 5E). When about to sequentially press downwards, the left-directed knitting pressing pieces Ef and De sequentially lift the right-directed pressing pieces eE and dD to disengage from the continuous cord material 100 before sequentially passing the right-directed knitting pressing pieces eE and dD. When the yarn feeder 10 reaches the back knitting needle d, the yarn feeder 10 stops guiding to the left side, as shown by the knitting process 5-2. Similarly, the yarn feeder 10 may keep guiding the continuous cord material 100 back and forth to the left and right sides, such that the continuous cord material 100 is continually pressed downwards to become stacked in the predetermined knitting section (the front loop 5D, the back loop 5*e* and the front loop 5E) till the number of stacked segments reaches a required number, i.e., equivalently till the number predetermined by the operator is reached, as shown by the knitting process 5-*n* (where n is a predetermined number greater than 2). Next, again referring to FIG. 10, after knitting is again performed along the carriage operation direction 30 to the right side, the front knitting needles A to E and the back knitting needles a to f sequentially stitch the face yarn 20 to form loops, as shown by the knitting process 6 in FIG. 10. Finally, after knitting is next performed along the carriage operation direction 30 to the left side, the back knitting needles f to a and the front knitting needles E to A sequentially stitch the face yarn 20 to form loops, as shown by the knitting process 7 in FIG. 10.

Figure 15:
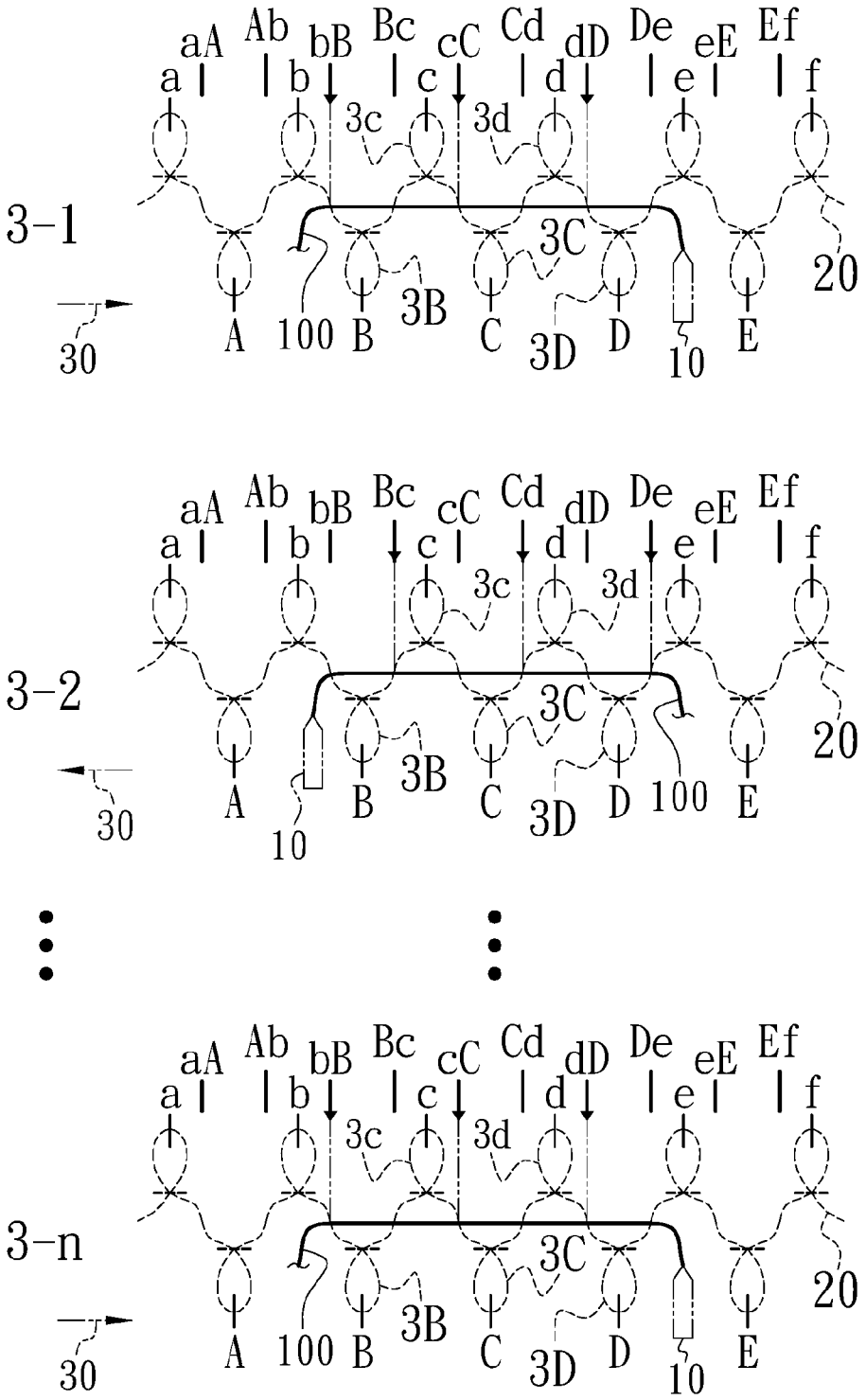
FIG. 15 is a detailed diagram of a symbol U in FIG. 14.
Figure 16:
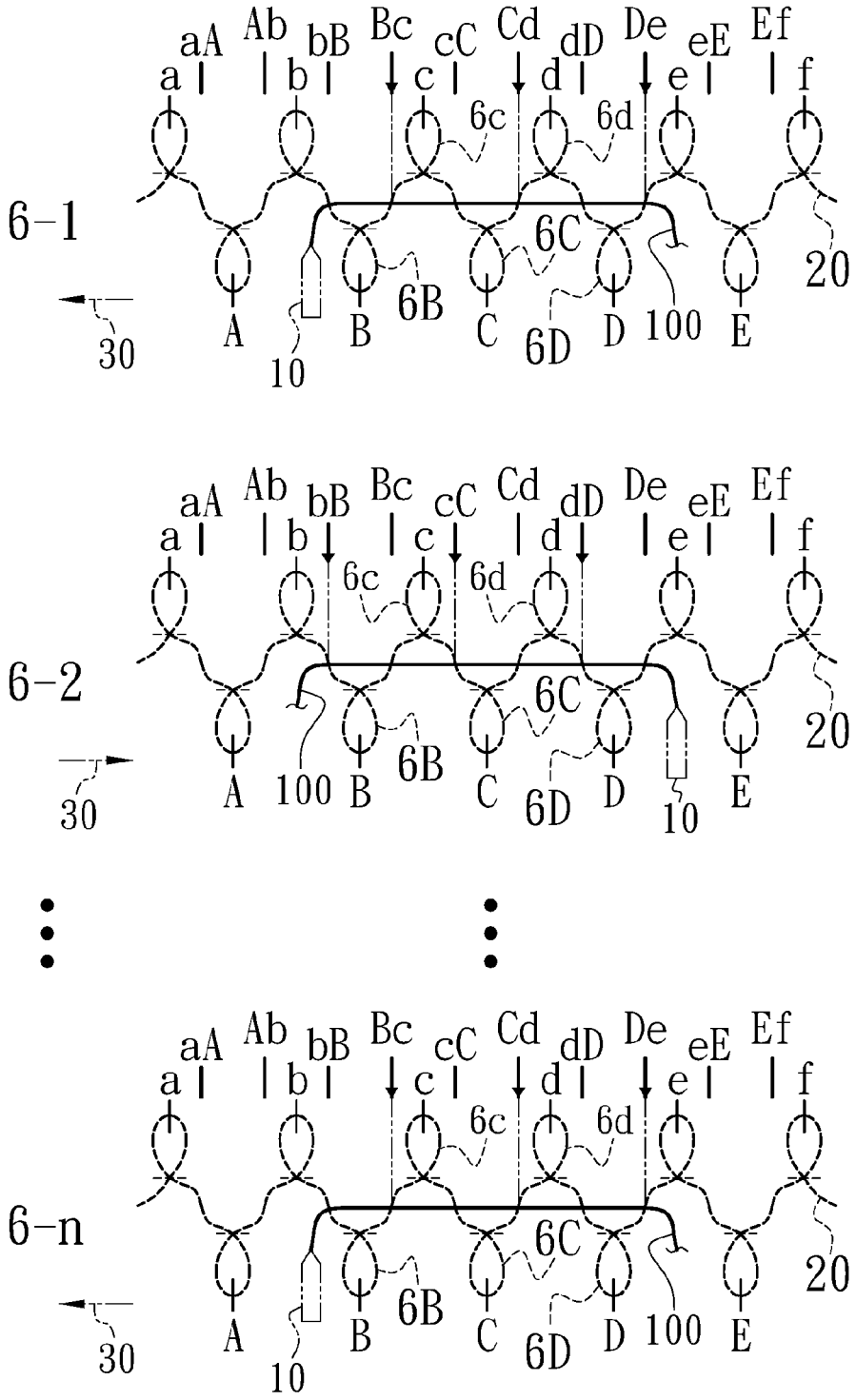
FIG. 16 is a detailed diagram of a symbol Win FIG. 14.

FIG. 13 to FIG. 16 show a partial planar structural schematic diagram, a diagram of partial knitting processes, and detailed diagrams of symbols U and W in the diagram of partial knitting processes according to a fourth preferred embodiment of the present invention. When the flat bed knitting machine applied in the present invention starts knitting along the carriage operation direction 30 to the left side as shown by the knitting process 1 in FIG. 14, the back knitting needles f to a and the front knitting needles E to A sequentially stitch the face yarn 20 to form loops. After knitting is next performed along the carriage operation direction 30 to the right side, the front knitting needles A to E and the back knitting needles a to f sequentially stitch the face yarn 20 to form loops, as shown by the knitting process 2 in FIG. 14. Further, after knitting is next performed along the carriage operation direction 30 to the left side, the back knitting needles f to a and the front knitting needles E to A sequentially stitch the face yarn 20 to form loops, as shown by the knitting process 3 in FIG. 14. At this point, the operator has set to embed a continuous cord material 100 into a predetermined knitting section (consisted of a front loop 3B, a back loop 3*c*, a front loop 3C, a back loop 3*d* and a front loop 3D formed from stitching the face yarn 20 by the front knitting needles B, C and D and the back knitting needles c and d in the same knitting process 3). Further refer to FIG. 15 showing a detailed diagram of the simplified knitting process diagram U in FIG. 14. At this point, the front knitting needles A to E and the back knitting needles a to f are controlled to stop knitting, and a yarn feeder 10 is caused to guide and feed the continuous cord material 100 from between the front knitting needles A and B of the front needle bed, and further guide the continuous cord material 100 from the left side to the right side above the predetermined knitting section (the front loop 3B, the back loop 3*c*, the front loop 3C, the back loop 3*d* and the front loop 3D), to cause the carriage operation direction 30 to move to the right side along with the operation direction of the yarn feeder 10. Further, the right-directed knitting pressing pieces bB, cC and dD are controlled to sequentially press the continuous cord material 100 downwards into the predetermined knitting section (the front loop 3B, the back loop 3*c*, the front loop 3C, the back loop 3*d* and the front loop 3D). Thus, when the yarn feeder 10 reaches the back knitting needle e, the yarn feeder 10 stops the guiding to the right side, as shown by the knitting process 3-1. Next, the yarn feeder 10 switches to guide the continuous cord material 100 to the left side to cause the continuous cord material 100 to be folded, and again causes the carriage operation direction 30 to move along with the operation direction of the yarn feeder 10. Further, the left-directed knitting pressing pieces De, Cd and Bc are controlled to sequentially press the continuous cord material 100 downwards into the predetermined knitting section (the front loop 3B, the back loop 3*c*, the front loop 3C, the back loop 3*d* and the front loop 3D). When about to sequentially press downwards, the left-directed knitting pressing pieces De, Cd and Bc sequentially lift the right-directed knitting pressing pieces dD, cC and bB to disengage from the continuous cord material 100 before sequentially passing the right-directed knitting pressing pieces dD, cC and bB. When the yarn feeder 10 reaches the back knitting needle b, the yarn feeder 10 stops guiding to the left side, as shown by the knitting process 3-2. Similarly, the yarn feeder 10 may keep guiding continuous cord material 100 back and forth to the left and right sides, such that the continuous cord material 100 is continually pressed downwards to become stacked in the predetermined knitting section (the front loop 3B, the back loop 3*c*, the front loop 3C, the back loop 3*d* and the front loop 3D) till the number of stacked segments reaches a required number, i.e., equivalently till the number predetermined by the operator is reached, as shown by the knitting process **3-*n* (where n is a predetermined number greater than 2). Again referring to FIG. 14, after knitting is again performed along the carriage operation direction 30 to the right side, the front knitting needles A to E and the back knitting needles a to f sequentially stitch the face yarn 20 to form loops, as shown by the knitting process 4. Further, after knitting is next performed along the carriage operation direction 30 to the left side, the back knitting needles f to a and the front knitting needles E to A sequentially stitch the face yarn 20 to form loops, as shown by the knitting process 5 in FIG. 14. Next, after knitting is again performed along the carriage operation direction 30 to the right side, the front knitting needles A to E and the back knitting needles a to f sequentially stitch the face yarn 20 to form loops, as shown by the knitting process 6 in FIG. 14. At this point, the operator has further set to embed a continuous cord material 100 into another predetermined knitting section (consisted of a front loop 6B, a back loop 6***c*, a front loop 6C, a back loop 6*d* and a front loop 6D formed from stitching the face yarn 20 by the front knitting needles B, C and D and the back knitting needles c and d in the same knitting process 6). Further refer to FIG. 16 showing a detailed diagram of the simplified knitting process diagram W in FIG. 14. At this point, the front knitting needles A to E and the back knitting needles a to f are controlled to stop knitting, and a yarn feeder 10 is caused to guide and feed the continuous cord material 100 from between the front knitting needles D and E of the front needle bed, and the carriage operation direction 30 is caused to move to the left side along with the operation direction of the yarn feeder 10. Further, the left-directed knitting pressing pieces De, Cd and Bc are controlled to sequentially press the continuous cord material 100 downwards into the predetermined knitting section (the front loop 6B, the back loop 6*c*, the front loop 6C, the back loop 6*d* and the front loop 6D). When the yarn feeder 10 reaches the back knitting needle b, the yarn feeder 10 stops the guiding to the left side, as shown by the knitting process 6-1. Next, the yarn feeder 10 switches to guide the continuous cord material 100 to the right side to cause the continuous cord material 100 to be folded, and again causes the yarn feeder 10 to guide the continuous cord material 100 from the left side to the right side above the predetermined knitting section (the front loop 6B, the back loop 6*c*, the front loop 6C, the back loop 6*d* and the front loop 6D), to cause the carriage operation direction 30 to move to the right side along with the operation direction of the yarn feeder 10. Further, the right-directed knitting pressing pieces bB, cC and dD are controlled to sequentially press the continuous cord material 100 downwards into the predetermined knitting section (the front loop 6B, the back loop 6*c*, the front loop 6C, the back loop 6*d* and the front loop 6D). When about to sequentially press downwards, the right-directed knitting pressing pieces bB, cC and dD sequentially lift the left-directed knitting pressing pieces Bc, Cd and De to disengage from the continuous cord material 100 before sequentially passing the left-directed knitting pressing pieces Bc, Cd and De. Thus, when the yarn feeder 10 reaches the back knitting needle e, the yarn feeder 10 stops guiding to the right side, as shown in the knitting process 6-2. Similarly, the yarn feeder 10 may keep guiding continuous cord material 100 back and forth to the left and right sides, such that the continuous cord material 100 is continually pressed downwards to become stacked in the predetermined knitting section (the front loop 6B, the back loop 6*c*, the front loop 6C, the back loop 6*d* and the front loop 6D) till the number of stacked segments reaches a required number, i.e., equivalently till the number predetermined by the operator is reached, as shown by the knitting process **6-*n* (where n is a predetermined number greater than 2). Again referring to FIG. 14, after knitting is next performed along the carriage operation direction 30 to the left side, the back knitting needles f to a and the front knitting needles E to A sequentially stitch the face yarn to form loops, as shown by the knitting process 7 in FIG. 14**.

What is claimed is:

1. A double-sided fabric stacked with a continuous cord material in a predetermined knitting section, the double-sided fabric is knit from a face yarn by a flat bed knitting machine comprising a front needle bed, a back needle bed and a loop presser bed, the front needle bed comprising a plurality of front knitting needles, the back needle bed comprising a plurality of back knitting needles, the loop presser bed disposed above the front needle bed or the back needle bed, the loop presser bed comprising a plurality of right-directed knitting pressing pieces and a plurality of left-directed knitting pressing pieces correspondingly alternately arranged in gaps of the plurality of front knitting needles and the plurality of back knitting needles, respectively, the double-sided fabric being characterized that:

the double-sided fabric is further embedded with at least one continuous cord material, which is pressed into the predetermined knitting section by the plurality of right-directed knitting pressing pieces and the plurality of left-directed knitting pressing pieces to become folded and stacked in the predetermined knitting section.

2. The double-sided fabric stacked with a continuous cord material in a predetermined knitting section of claim 1, wherein the continuous cord material is guided and fed in from the front needle bed towards the double-sided fabric, and guided towards the front needle bed to depart the double-sided fabric.

3. The double-sided fabric stacked with a continuous cord material in a predetermined knitting section of claim 1, wherein the continuous cord material is guided and fed in from the front needle bed towards the double-sided fabric, and guided towards the back needle bed to depart the double-sided fabric.

4. The double-sided fabric stacked with a continuous cord material in a predetermined knitting section of claim 1, wherein the continuous cord material is guided and fed in from the back needle bed towards the double-sided fabric, and guided towards the back needle bed to depart the double-sided fabric.

5. The double-sided fabric stacked with a continuous cord material in a predetermined knitting section of claim 1, wherein the continuous cord material is guided and fed in from the back needle bed towards the double-sided fabric, and guided towards the front needle bed to depart the double-sided fabric.

6. The double-sided fabric stacked with a continuous cord material in a predetermined knitting section of claim 1, wherein the predetermined knitting section is consisted of front loops and a back loop formed from stitching the face yarn by at least two front knitting needles and at least one back knitting needle in a same knitting process.

7. The double-sided fabric stacked with a continuous cord material in a predetermined knitting section of claim 2, wherein the predetermined knitting section is consisted of front loops and a back loop formed from stitching the face yarn by at least two front knitting needles and at least one back knitting needle in a same knitting process.

8. The double-sided fabric stacked with a continuous cord material in a predetermined knitting section of claim 3, wherein the predetermined knitting section is consisted of front loops and a back loop formed from stitching the face yarn by at least two front knitting needles and at least one back knitting needle in a same knitting process.

9. The double-sided fabric stacked with a continuous cord material in a predetermined knitting section of claim 4, wherein the predetermined knitting section is consisted of front loops and a back loop formed from stitching the face yarn by at least two front knitting needles and at least one back knitting needle in a same knitting process.

10. The double-sided fabric stacked with a continuous cord material in a predetermined knitting section of claim 5, wherein the predetermined knitting section is consisted of front loops and a back loop formed from stitching the face yarn by at least two front knitting needles and at least one back knitting needle in a same knitting process.

11. The double-sided fabric stacked with a continuous cord material in a predetermined knitting section of claim 1, wherein the predetermined knitting section is consisted of a front loop and back loops formed from stitching the face yarn by at least one front knitting needle and at least two back knitting needles in a same knitting process.

12. The double-sided fabric stacked with a continuous cord material in a predetermined knitting section of claim 2, wherein the predetermined knitting section is consisted of a front loop and back loops formed from stitching the face yarn by at least one front knitting needle and at least two back knitting needles in a same knitting process.

13. The double-sided fabric stacked with a continuous cord material in a predetermined knitting section of claim 3, wherein the predetermined knitting section is consisted of a front loop and back loops formed from stitching the face yarn by at least one front knitting needle and at least two back knitting needles in a same knitting process.

14. The double-sided fabric stacked with a continuous cord material in a predetermined knitting section of claim 4, wherein the predetermined knitting section is consisted of a front loop and back loops formed from stitching the face yarn by at least one front knitting needle and at least two back knitting needles in a same knitting process.

15. The double-sided fabric stacked with a continuous cord material in a predetermined knitting section of claim 5, wherein the predetermined knitting section is consisted of a front loop and back loops formed from stitching the face yarn by at least one front knitting needle and at least two back knitting needles in a same knitting process.

* * * * *